United States Patent [19]

Matsubara

[11] Patent Number: 4,933,655

[45] Date of Patent: Jun. 12, 1990

[54] MOUNTING STRUCTURE OF A REED SWITCH FOR AN EDDY-CURRENT INDICATOR

[75] Inventor: Yukio Matsubara, Shizuoka, Japan

[73] Assignee: Yazaki Corporation, Japan

[21] Appl. No.: 391,307

[22] Filed: Aug. 9, 1989

[30] Foreign Application Priority Data

Aug. 10, 1988 [JP] Japan ..... 63-104971[U]

[51] Int. Cl.[5] ..... H01H 45/04; H01H 9/00

[52] U.S. Cl. ..... 335/205; 335/151; 335/193

[58] Field of Search ..... 335/90, 193, 277, 205, 335/206, 207, 151, 152, 153, 154; 200/288, 301

[56] References Cited

U.S. PATENT DOCUMENTS 4,409,577 10/1983 Holce et al. ..... 335/205

4,595,897 6/1986 Amano et al. ..... 335/205

*Primary Examiner*—H. Broome

*Attorney, Agent, or Firm*—Wigman & Cohen

[57] ABSTRACT

Disclosed herein is a mounting structure of a reed switch in an eddy-current-type indicator which can realize to lessen an operation vibration sound of the reed switch. The mounting structure comprises a housing, a magnet rotatably provided in the housing, a pair of terminals mounted on the housing, a reed switch for detecting the number of the rotation of the magnet by generating pulse corresponding to the rotation of the magnet, the reed switch having a pair of leg portions electrically connected to the terminals, respectively, and cushion members for preventing vibration generated in the reed switch when it is operated from being transmitted to the housing and terminals. The cushion members elastically contact with the leg portions of the reed switch, so that the operation vibration is absorbed by the cushion members.

7 Claims, 7 Drawing Sheets

MOUNTING STRUCTURE OF A REED SWITCH FOR AN EDDY-CURRENT INDICATOR

BACKGROUND OF THE INVENTION

1. Field of the Invention

The present invention relates to a mounting structure of a reed switch for detecting rotation of a magnet which is provided in an eddy-current indicator such as an eddy-current speed meter or tachometer for a vehicle.

2. Description of the Prior Art

Generally, an eddy-current indicator has a magnet which is rotated in proportion to the number of rotation of wheels or an engine of a vehicle, and an induction plate which is able to pivot with crossing a magnetic flux formed by the magnet. In the eddy-current indicator, eddy-current corresponding to the rotation of the magnet is generated in the induction plate, and the eddy-current further makes the induction plate pivoted in accordance with the rotation number of the magnet, so that a speed of the vehicle or rotation number of the engine can be indicated by a pivot angle of a pointer which is mounted on the induction plate.

In the eddy-current indicators as described above, there is known one indicator having a digital display device for indicating speed or rotation number in addition to the the analog display by the pointer. The digital display device comprises a reed switch as a rotation sensor which is arranged in the vicinity of the magnet. The reed switch generates pulse having a period corresponding to the rotation number of the magnet by an on-off control of the reed switch in accordance with magnetic fields generated by the rotation of the magnet, and then the pulse is processed into the digital form.

As a structure for mounting the above-mentioned reed switch in a housing holding therein the magnet rotatably, there is known a structure shown in FIGS. 1 to 5.

In these drawings, a housing 1 is formed of a resin material integrally molded. As shown in FIG. 1, the housing 1 has a concave portion 3 having a long and narrow opening 2 at the side of the central portion of the housing 1. In the concave portion 3 of the housing 1, an assembly body 5 having a reed switch 4 is provided such that the reed switch 4 is disposed in the opening 2.

As shown in FIGS. 2 and 3, the assembly body 5 includes an insulating plate 7 (distributing plate) having copper-leaf conductive bodies 6*a*, 6*b* at the top surface thereof. A pair of terminals 8*a*, 8*b* are secured at the distributing plate 7 with rivets 9*a*, 9*b*, respectively, and therefore the terminals 8*a*, 8*b* are electrically connected to the copper-leaf conductive bodies 6*a*, 6*b*, respectively. The reed switch 4 is arranged between side arm portions 7*a*, 7*b* of the distributing plate 7. The reed switch 4 has leg portions 4*a*, 4*b* which extend toward the opposite directions. The tip parts of the leg portions 4*a*, 4*b* are formed into a hook-shape, respectively, which is engaged with each of the side arms 7*a*, 7*b* of the distributing plate 7 from the underside of the side arms 7*a*, 7*b*. In this state, the leg portions are in contact with the under surfaces of the side arms. The ends of the hook-shape tip parts of the leg portions 4*a*, 4*b* are respectively secured to the the copper-leaf conductive bodies 6*a*, 6*b* by soldering at soldering points 15*a*, 15*b* as shown in FIG. 3. Thus, the reed switch 4 is electrically connected to the copper-leaf conductive bodies 6*a*, 6*b*.

The above-mentioned assembly body 5 is mounted in the concave portion 3 of the housing 1 as shown in FIGS. 4 and 5. Then, the reed switch 4 of the assembly body 5 is accommodated in the opening 2 of the housing 1, and further the terminals 8*a*, 8*b* are secured on a wall 1*a* of the housing 1 with screws 10*a*, 10*b*, respectively. In this mounting state, the reed switch 4 is disposed near a magnet (not shown) which is held rotatably in the housing 1. The magnet is connected to a rotation transmission rod (not shown) which passes through a bearing lb of the housing 1. To the transmission rod, a pointer is mounted.

Incidentally, in FIGS. 1 to 5, the reference numerals 11*a*, 11*b* denote holes which are formed in the concave portion 3 of the housing 1 to contain head portions 9*c*, 9*d* of the revets 9*a*, 9*b* therein. The reference numerals 12*a*, 12*b* denote holes formed in the wall la of the housing 1 for mounting the screws 10*a*, 10*b* therein which pass through screw holes 13*a*, 13*b* formed in bending vertical portions of the terminals 8*a*, 8b. The reference numerals 21*a*, 21*b* are recess portions formed in both sides of the opening 2 of the concave portion 3, in which the leg portions 4*a*, 4*b* of the reed switch 4 are contained respectively so as not to directly contact with the housing 1.

In the above-mentioned structure, there is a disadvantage that when the reed switch 4 is subjected to an on-off control, vibration is caused by the operation of the reed switch and the operation vibration energy is transmitted to not only the side arms 7*a*, 7*b* of the distributing plate 7 but also the housing 1 through the leg portions 4*a*, 4*b* of the reed switch 4. This is because the leg portions 4*a*, 4*b* are in contact with the side arms 7*a*, 7*b* of the distributing plate 7 at the under side of the side arms. The transmitted vibration generates a strong resonance sound (an operation vibration sound of the reed switch) when the rotation of the magnet reaches at a certain number.

FIG. 6 shows frequency characteristics of the operation sound generated in an eddy-current indicator which does not have a reed switch at a certain car speed, and FIG. 7 shows frequency characteristics of the operation sound generated in an eddy-current indicator which has the reed switch mounted by the above-mentioned mounting structure. As apparently seen from the drawings, when the reed switch is provided, a strong resonance sound having a peak at about 4 kHz is generated, which is not seen in the case that the reed switch is not provided.

SUMMARY OF THE INVENTION

Therefore, it is an object of the present invention to provide mounting structure of a reed switch in an eddy-current indicator, which is capable of lessening an operation vibration sound generated by provision of a reed switch in the eddy-current indicator.

In order to achieve the object, a mounting structure of a reed switch in an eddy-current indicator according to the present invention, comprises a housing, a magnet rotatably provided in the housing, a pair of terminals mounted on the housing, a reed switch for detecting the number of the rotation of the magnet by generating pulse corresponding to the rotation of the magnet, the reed switch having a pair of leg portions electrically connected to the terminals, respectively, and means for preventing vibration generated in the reed switch when it is operated from being transmitted to the housing and terminals.

The vibration transmission preventing means comprises cushion members which elastically contact with the leg portions of the reed switch.

In the above-mentioned structure, the resonance sound can be prevented because the cushion members are always in elastically contact with the leg portions of the reed switch so that the operation vibration energy of the reed switch is absorbed in the cushion members, thereby the energy is not transmitted to the terminals and the housing.

The cushion members may be formed of a foam resin or a foam rubber. Further, it is possible for the housing to form a concave portion having a long and narrow opening having opposite side portions and provide the reed switch in the opening, and to provide the cushion members at the opposite side portions, respectively.

Furthermore, it is also possible to bent each of the tip portions of the leg portions into a U-shape, and then to electrically connect the end of the U-shape tip portion of the leg portion to the upper side of terminal from the underside of the terminal such that the other portion of the leg portion does not contact with the terminal with keeping a gap between the other portion and the terminal.

These and other objects, features and advantages of the present invention will be more apparent from the following description of a preferred embodiment, taken in conjunction with the accompanying drawings.

BRIEF DESCRIPTION OF THE DRAWINGS

FIGS. 1 to 5 show a conventional mounting structure of a reed switch, in which FIG. 1 is a perspective view of a housing, FIG. 2 is a exploded perspective view of an assembly body, FIG. 3 is an a perspective view of the assembly body, FIG. 4 is a perspective view for explaining the mounting state of a reed switch to the housing and FIG. 5 is a cross sectional view taken along line B—B in FIG. 4.

DETAILED DESCRIPTION OF THE PREFERRED EMBODIMENT

Hereinafter, embodiments according to the present invention will be described in accordance with drawings.

Figure 1:
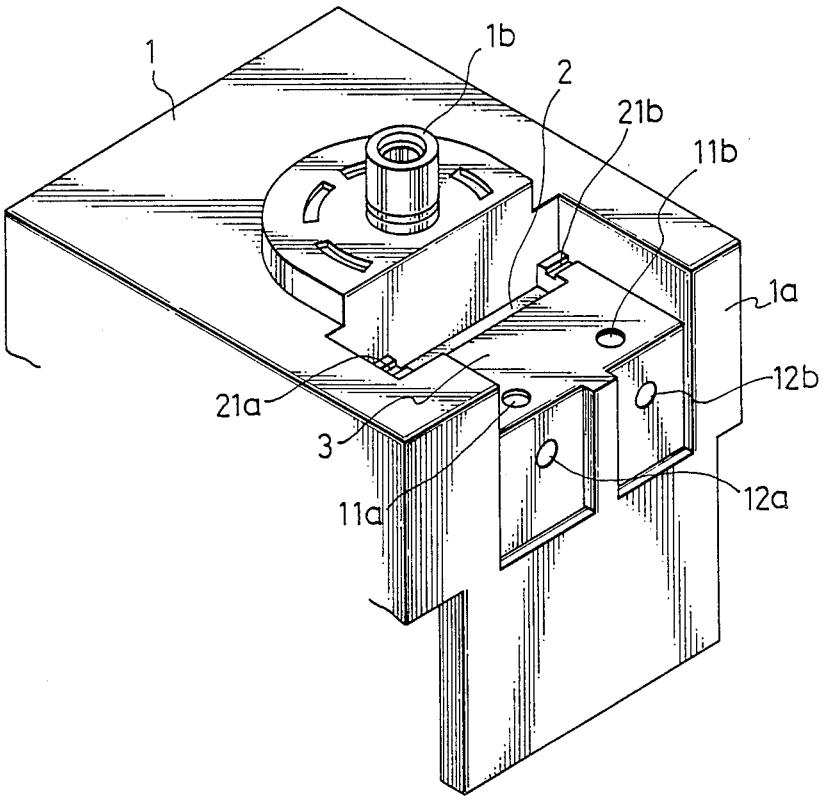
FIG. 1 PRIOR ART
Figure 2:
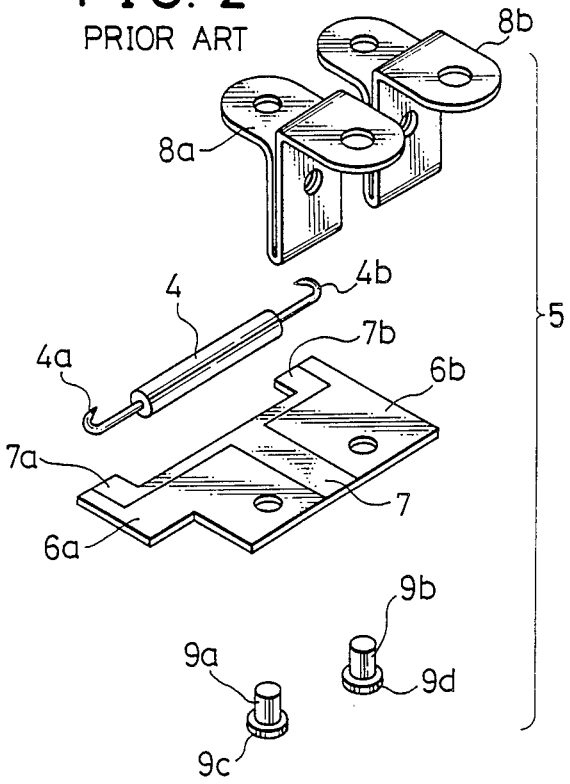
FIG. 2 PRIOR ART
Figure 3:
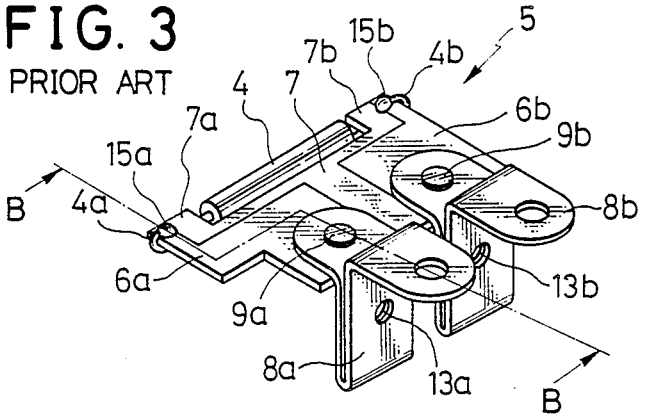
FIG. 3 PRIOR ART
Figure 4:
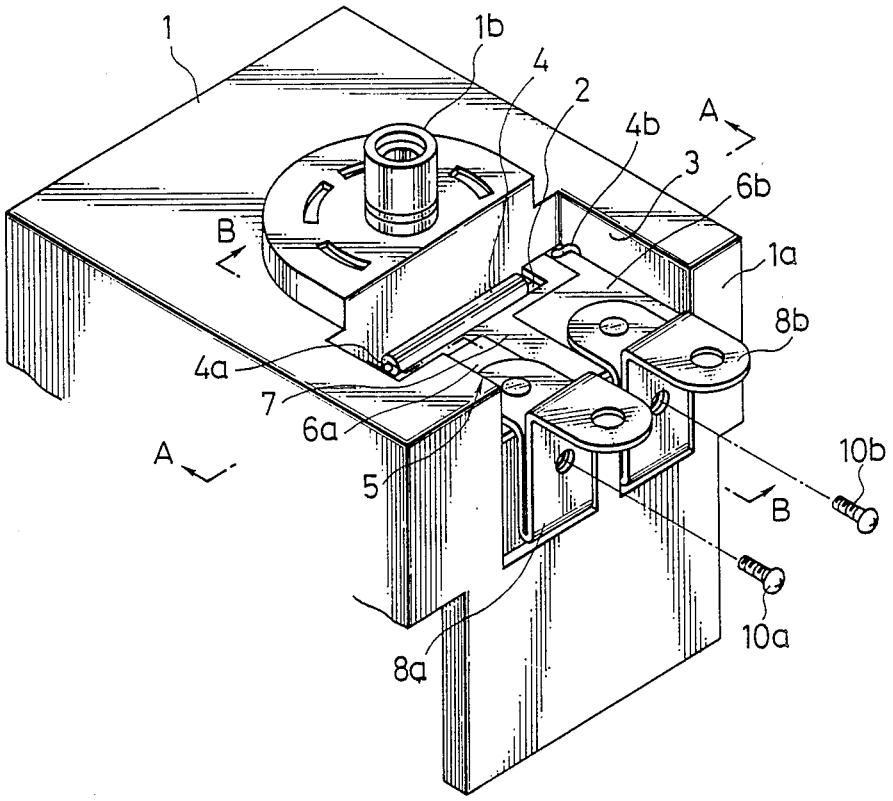
FIG. 4 PRIOR ART
Figure 5:
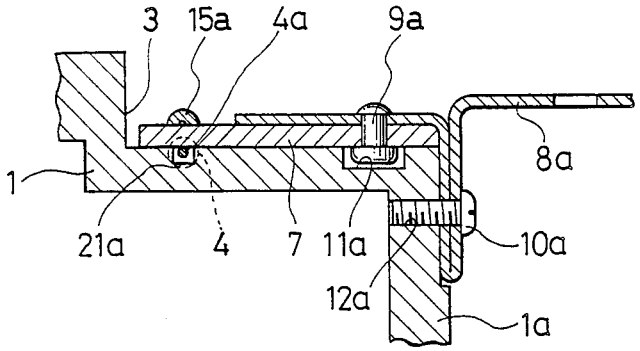
FIG.5 PRIOR ART
Figure 6:
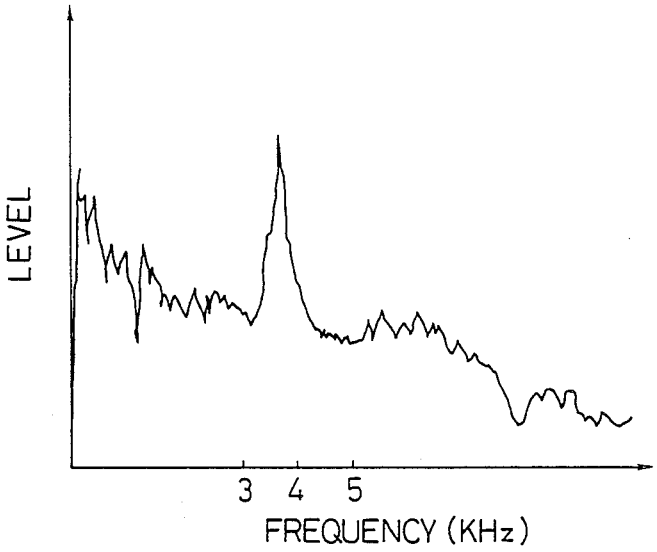
FIG. 6 is a graph showing an operation sound characteristic of an eddy-current indicator having no reed switch.
Figure 7:
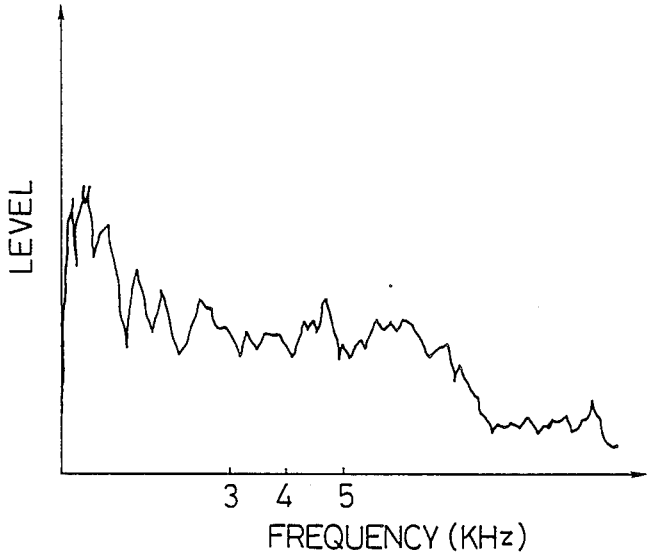
FIG. 7 is a graph showing an operation sound characteristic of an eddy-current indicator having the conventional reed switch.
Figure 8:
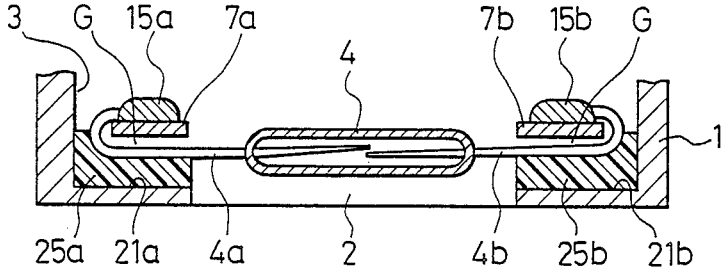
FIG. 8 shows a cross sectional view of a primary portion of an embodiment of a mounting structure of a reed switch in an eddy-current indicator according to the present invention.

FIG. 8 shows a cross sectional view of an embodiment of a mounting structure of a reed switch in an eddy-current indicator according to the present invention, and this cross sectional view is corresponding to a view taken along line A—A in FIG. 4. Other parts which are not shown in the drawing are the same as conventional one which is described in FIGS. 1 to 5, thus it is believed to be unnecessary to explain.

As shown in FIG. 8, the reed switch 4 is arranged between both side arms 7*a*, 7*b* of a distributing plate 7. The reed switch 4 has leg portions 4*a*, 4*b* which extend opposite directions on the underside of the side amrs 7*a*, 7*b* with keeping a certain space between each of the side arms and the leg portion. The tip parts of the leg portions 4*a*, 4*b* are bent into a U-shape, respectively. Only end portions of the tip parts of the leg portions 4*a*, 4*b* are respectively secured to the copper-leaf conductive bodies 6*a*, 6*b* provided on the top surface of the side amrs 7*a*, 7*b* by soldering at soldering points 15*a*, 15*b* as shown in FIG. 8. Thus, the reed switch 4 is electrically connected to the copper-leaf conductive bodies 6*a*, 6*b*.

As a result, between each of the leg portions 4*a*, 4*b* of the reed switch 4 which is secured to the distributing plate 7 as mentioned above and the under surface of each of the side arms 7*a*, 7*b* of the distributing plate 7, there is provided a suitable space G such that the leg portions 4*a*, 4*b* do not directly contact with the under surfaces of the side arms 7*a*, 7*b*.

On the bottom of each of the recesses 21*a*, 21*b* which are formed on opposite sides of a long and thin opening 2 provided in a concave portion 3 of a housing 1, a substantially plate-shaped cushion member 25*a*, 25*b* is disposed, respectively. Each of the cushion members 25*a*, 25*b* comprises for example a foam resin or a foam rubber having a substantially rectangular shape. The cushion member may be secured to the bottom of the recess with an adhesive, respectively. Then, the leg portions 4*a*, 4*b* of the reed switch 4, particularly portions thereof which constitute the spaces G with respect to the side arms 7*a*, 7*b* of the distributing plate 7, can fully and elastically contact with the surfaces of the cushion members 25*a*, 25*b* under urged state.

In the above-mentioned structure, since the cushion members 25*a*, 25*b* always contact with the portions of the leg portions 4*a*, 4*b* of the reed switch 4 elastically, an operation vibration energy generated in the reed switch 4 is absorbed in the cushion members 25*a*, 25*b*, so that the vibration energy is not transmitted to the side arms 7*a*, 7*b* of the distributing plate 7 and the housing 1, thus generation of a resonance sound can be prevented.

Particularly, since the leg portions 4*a*, 4*b* of the reed switch 4 are soldered at only the ends of the U-shaped tip parts thereof to the copper-leaf conductive bodies 6*a*, 6*b* provided on the top surfaces of the side arms 7*a*, 7*b* with keeping the certain space G between the leg portions and the side arms 7*a*, 7*b* of the distributing plate 7, a sufficient contact area can be obtained between the leg portions 4*a*, 4*b* and cushion members 25*a*, 25*b*. Therefore, the operation vibration energy of the reed switch 4 is well absorbed in the cushion members 25*a*, 25*b* before it reaches the securing portions of the leg portions 4*a*, 4*b* to the side arms 7*a*, 7*b*. As a result, the transmission of the vibration to the side arms 7*a*, 7*b* can be effectively prevented.

In the above-mentioned embodiment, the spaces G are arranged between the leg portions 4*a*, 4*b* and the under surfaces of the side arms 7*a*, 7*b* of the distributing plate 7, respectively. However, please note that the provision of these spaces are not essential to the present invention although the prevention effect for the vibration transmission may be somewhat lowered if they are not provided. However, what is the most important in this structure is to absorb the vibration generated in the leg portions 4*a*, 4*b* by the cushion members 25*a*, 25*b*.

Figure 9:
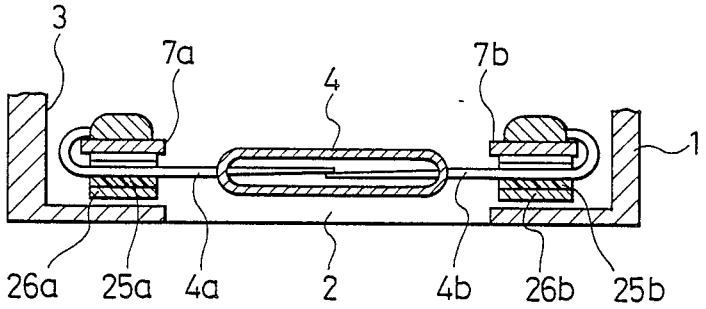
FIG. 9 shows a cross sectional view of a primary portion of another embodiment of a mounting structure of a reed switch in an eddy-current indicator according to the present invention.

In the embodiment shown in FIG. 8, the cushion members 25*a*, 25*b* are secured to the bottom portions of the recesses 21*a*, 21*b*, but the cushion members may be fixed on support members 26*a*, 26*b* which are mounted on the distributing plate 7 so as to elastically protrude into the opening as shown in FIG. 9. According to this embodiment of FIG. 9, the vibration can be also absorbed by the support members 26*a*, 26*b*.

Figure 10:
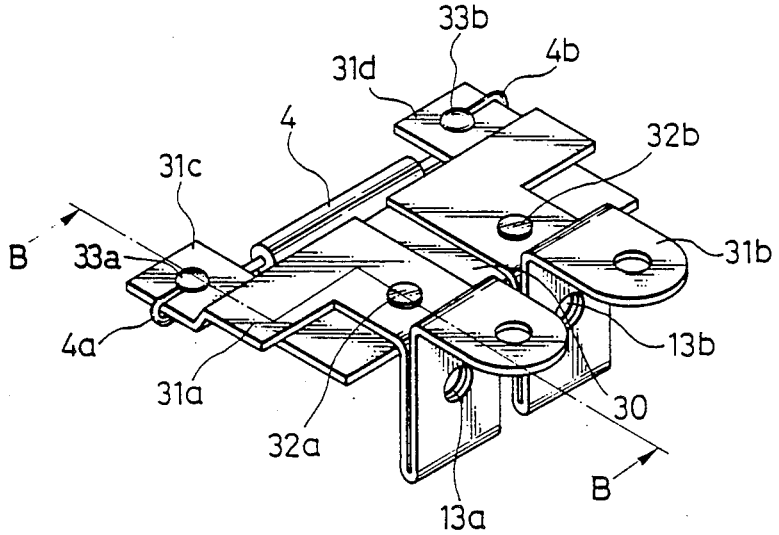
FIGS. 10 and 11 show a cross sectional view and a perspective view of still another embodiment according to the present invention.
Figure 11:
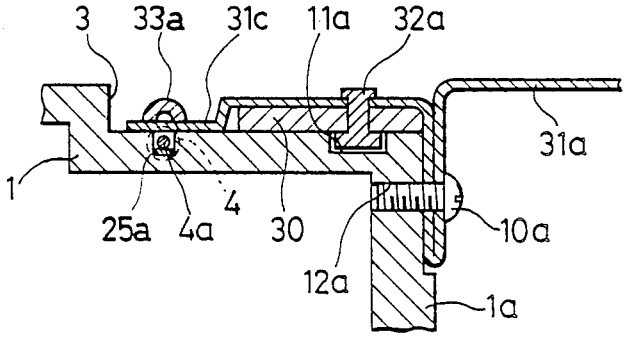

Moreover, please also note that the side arms 7*a*, 7*b* of the distributing plate 7 are not essential. Namely, as shown in FIGS. 10 and 11, it is possible to provide a pair of terminals 31*a*, 31*b* which are secured to an insulating plate 30 comprising a phenol resin or the like with revets 32*a*, 32*b*. In this case, the leg portions 4*a*, 4*b* of the reed switch 4 are in engagement with bending ends 31*c*, 31*d* of the terminals 31*a*, 31*b* and are fixed by soldering at soldering sections 33*a*, 33*b*, respectively.

Figure 12:
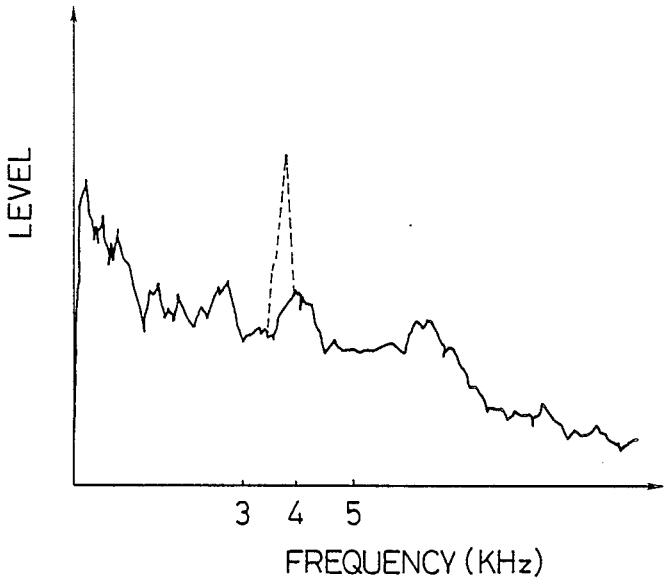
FIG. 12 is a graph showing an operation sound characteristic of an eddy-current indicator for explaining the effect in each embodiment according to the present invention.

FIG. 12 shows an operation sound characteristic of an overcurrent-type indicator with the above-mentioned mounting structure according to the present invention, as apparently seen from the drawing, an operation vibration sound generated from the reed switch, which is represented by a dot line, is dissolved.

In summary, according to the present invention, since the cushion members are always in contact with the leg portions of the reed switch elastically, the operation vibration energy generated from the reed switch is absorbed in the cushion members, so that the vibration energy is not transmitted to a pair of the side arms and the housing, thereby the generation of a resonance sound being prevented.

Various modifications will become possible for those skilled in the art after receiving the teachings of the present disclosure without departing from the scope thereof.

What is claimed is:

1. A mounting structure of a reed switch in an eddy-current indicator, which comprises:

a housing;

a magnet rotatably provided in the housing;

a pair of terminals mounted on the housing with a certain space therebetween;

a reed switch mounted on the housing for detecting the number of the rotation of the magnet by generating pulse corresponding to the rotation of the magnet, the reed switch having a pair of leg portions electrically connected to the terminals, respectively; and means for preventing vibration generated in the reed switch when it is operated from being transmitted to the housing and terminals through the leg portions of the reed switch.

2. The mounting structure as claimed in claim 1, wherein the vibration transmission preventing means comprises cushion members with which the leg portions of the reed switch elastically contact.

3. The mounting structure as claimed in claim 2, wherein the cushion members are formed of a foam resin.

4. The mounting structure as claimed in claim 2, wherein the cushion members are formed of a foam rubber.

5. The mounting structure as claimed in claim 2, wherein the housing has a concave portion having a long and narrow opening having opposite side portions, and the reed switch is provided in the opening and the cushion members are provided at the opposite side portions, respectively.

6. The mounting structure as claimed in claim 5, wherein each of tip portions of the leg portions of the reed switch is bent into a U-shape and each of the terminals has an upper surface, and the reed switch is arranged between the terminals in such a manner that only each of end portions of the U-shaped tip parts of the leg portions is secured to the upper surface of the terminal from the underside of the terminal with keeping a space between the other portion of the leg portion and the terminal.

7. The mounting structure as claimed in claim 6, wherein the vibration transmission preventing means further comprises a pair of supporting plates elastically protruded into the opening, on which the cushion members are mounted, respectively.

* * * * *